US009207649B2

(12) United States Patent
Hasegawa

(10) Patent No.: US 9,207,649 B2
(45) Date of Patent: Dec. 8, 2015

(54) ANALOG ELECTRONIC TIMEPIECE AND HAND MOVEMENT CONTROLLING METHOD THEREOF

(71) Applicant: CASIO COMPUTER CO., LTD., Shibuya-ku, Tokyo (JP)

(72) Inventor: Kosuke Hasegawa, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/634,479

(22) Filed: Feb. 27, 2015

(65) Prior Publication Data

US 2015/0268638 A1 Sep. 24, 2015

(30) Foreign Application Priority Data

Mar. 20, 2014 (JP) ..... 2014-057548

(51) Int. Cl.
*G04R 20/04* (2013.01)
*G04C 3/14* (2006.01)
*G04G 9/00* (2006.01)

(52) U.S. Cl.
CPC *G04R 20/04* (2013.01); *G04C 3/14* (2013.01); *G04G 9/0064* (2013.01)

(58) Field of Classification Search
CPC ..... G04R 20/00; G04R 20/02; G04R 20/04; G04R 20/08; G04R 20/14; G04G 9/0064; G04C 3/14
USPC ..... 368/47; 342/357.66, 357.67
See application file for complete search history.

(56) References Cited

U.S. PATENT DOCUMENTS

2009/0189809 A1* 7/2009 Baba ..... G01S 1/047 342/357.57
2013/0051188 A1* 2/2013 Akiyama ..... G04R 20/04 368/47
2014/0086021 A1* 3/2014 Baba ..... G01S 10/02 368/47

FOREIGN PATENT DOCUMENTS

JP 2009236560 A 10/2009
JP 2011163912 A 8/2011

* cited by examiner

*Primary Examiner* — Vit W Miska
(74) *Attorney, Agent, or Firm* — Holtz, Holtz, Goodman & Chick PC

(57) ABSTRACT

An analog electronic timepiece including: a radiowave receiver that receives radiowaves from positioning satellites, acquires preassigned target data from the received radiowaves and outputs the acquired target data; a hand that is provided to be rotatable; a time calculator that calculates a turnaround time from input of a reception command for the radiowaves to the radiowave receiver to output of the acquired target data; and a notification controller that instructs the hand to carry out a predetermined notification movement during reception of the radiowaves and finish the notification movement at a timing when the turnaround time elapses.

20 Claims, 8 Drawing Sheets

ANALOG ELECTRONIC TIMEPIECE AND HAND MOVEMENT CONTROLLING METHOD THEREOF

BACKGROUND OF THE INVENTION

1. Field of the Invention

The present invention relates to an analog electronic timepiece that receives radiowaves from positioning satellites to acquire date and time information and positional information, and a method of controlling the movement of the hands of the analog electronic timepiece.

2. Description of Related Art

Conventionally, electronic clocks (atomic clocks) have been known that receive radiowaves from satellites (positioning satellite) in global navigation satellite systems (GNSSs) to correct the date, time, and position (time zones) and determine positions. The received radiowaves are usually processed with a module that comprehensively performs reception, data deciphering, and calculation of the positional information. The processed date and time data and the positioning data are sent from the module to controllers of electronic devices.

Accurate data on date, time, and position can be acquired from the radiowaves sent from the positioning satellites usually in the form of 30-second data sets from four or more positioning satellites. Unfortunately, the reception time varies depending on conditions, such as information on the predicted orbits of the positioning satellites and obstacles blocking the radiowaves from the positioning satellites. Various techniques are known for the calculation of date, time, and position through a shorter reception time so as to reduce the power consumption and dimensions of the clocks.

An electronic clock usually displays the reception state of radiowaves during the reception of radiowaves. If the reception time varies as described above, the user of a portable electronic timepiece will not know how long to remain in a stand-by mode for the maintenance of satisfactory reception and the acknowledgement of reception results. Japanese Patent Application Laid-Open No. 2009-236560 discloses a technique for the prediction of the remaining reception time on the basis of the tracking state of the radiowaves from the positioning satellites and the content of data being received, and displaying the predicted remaining reception time.

Another technique is known for analog electronic timepieces that display time with hands that point to marks provided at predetermined hand positions to indicate the reception of radiowaves. If the reception of radiowaves is completed in a short time, the reception will finish while the hands are still in motion. The hands must return to the original positions before the hands reach their destinations, resulting in redundant movement of the hands. Japanese Patent Application Laid-Open No. 2011-163912 discloses a technique for an analog electronic timepiece to move a hand in advance to a position indicating the reception end time predicted on the basis of the delimiter in the format of the received data, and pause the movement of the hand.

If the hand of an analog electronic timepiece stops at different positions, the user cannot readily confirm the reception of radiowaves by the electronic timepiece. Moving a hand during reception requires a sequence of many control commands involving the movement. This may cause a delay in the acquisition timing of data, and thus, a delay in the acquisition of the date and time, resulting in low accuracy.

The present invention provides an analog electronic timepiece that can reliably inform a user about being in a state of receiving radiowaves without lowering the accuracy of the date and time data acquired in the form of radiowaves, and a method of controlling the movement of a hand of the analog electronic timepiece.

SUMMARY OF THE INVENTION

According to one aspect of the present invention, there is provided an analog electronic timepiece including: a radiowave receiver that receives radiowaves from positioning satellites, acquires preassigned target data from the received radiowaves and outputs the acquired target data; a hand that is provided to be rotatable; a time calculator that calculates a turnaround time from input of a reception command for the radiowaves to the radiowave receiver to output of the acquired target data; and a notification controller that instructs the hand to carry out a predetermined notification movement during reception of the radiowaves and finish the notification movement at a timing when the turnaround time elapses.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

Embodiments of the present invention will now be described with reference to the accompanying drawings.

Figure 1:
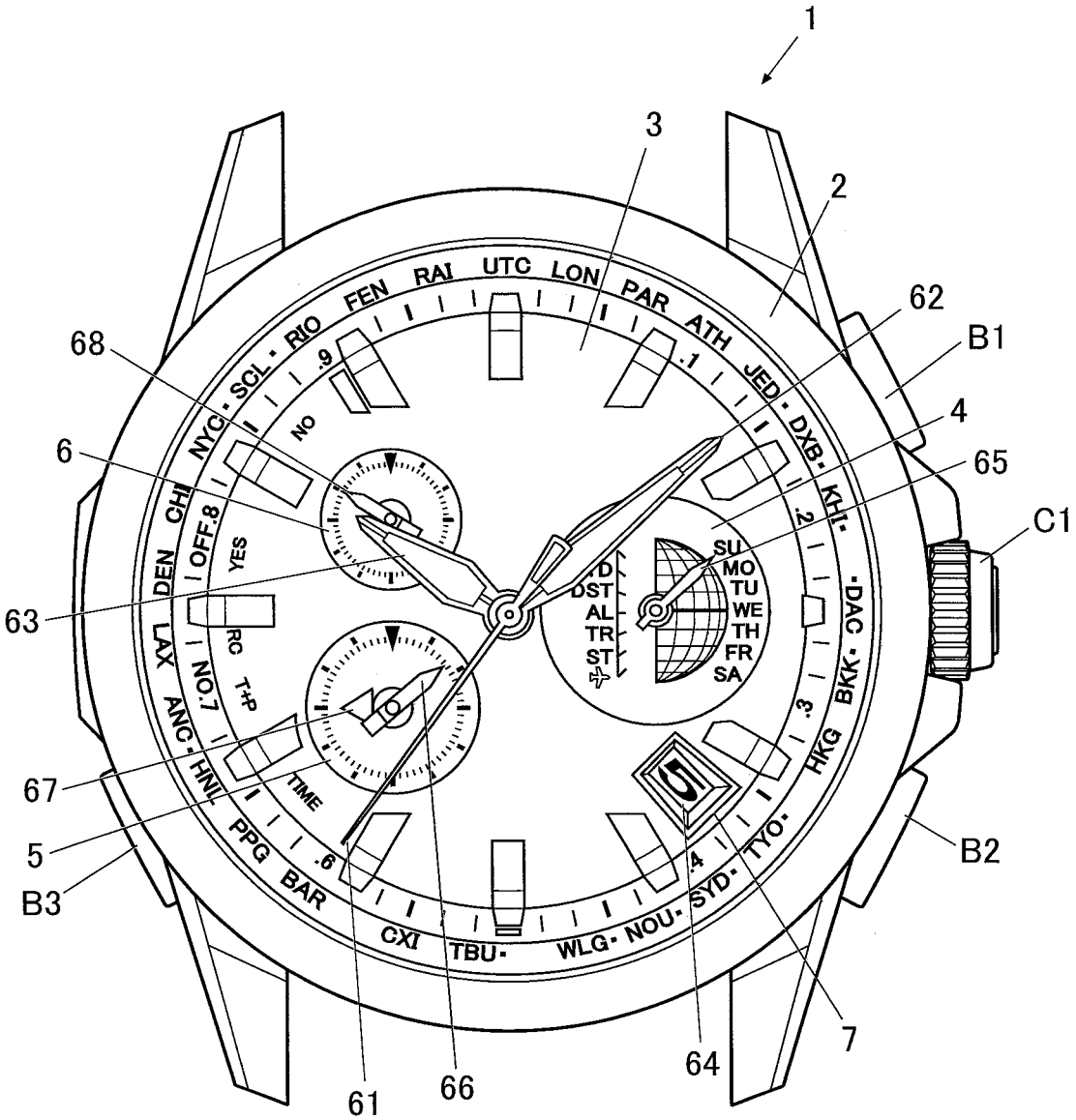
FIG. 1 is a front view illustrating an analog electronic timepiece according to an embodiment of the present invention.

FIG. 1 is a front view illustrating an analog electronic timepiece according to an embodiment of the present invention.

The analog electronic timepiece 1 includes a casing 2 that accommodates the following components; a clock face 3 disposed in the casing 2 and having an exposed external surface (exposed surface); a transparent member (windproof glass) (not shown) that covers the exposed surface of the clock face 3; three hands 61, 62 and 63 that revolve around a rotary axis at the substantial center of the clock face 3 over the substantially entire surface of the clock face 3 between the clock face 3 and the windproof glass, and point to markers and numbers provided near the outer edge of the clock face 3; a small window 4 that is provided at the three o'clock position on the clock face 3 and a mode hand 65 (hand) that rotates in the small window 4; a small window 5 that is provided at the eight o'clock position on the clock face 3, and functional hands 66 and 67 that rotate in the small window 5; a small window 6 that is provided at the ten o'clock position on the clock face 3 and a 24-hour hand 68 that rotates in the small window 6; a date wheel 64 that is disposed parallel to the clock face 3 on the side remote from the exposed surface of the clock face 3 and rotates to expose numbers through an opening 7 provided at the four-thirty position on the clock face 3; and a crown C1 and push-button switches B1, B2 and B3 that are disposed on the side of the casing 2 on the exposed surface of the clock face 3.

The hands 61 to 63 serve as a second hand 61, a minute hand 62, and a hour hand 63, which usually indicate the second, minute, and hour, respectively, of the displayed time. The date wheel 64 has numbers indicating dates printed in sequence on the circumference at equal intervals. One of these numbers is exposed through the opening 7 to indicate the date. The second hand 61 of the analog electronic timepiece 1 according to this embodiment indicates various functions and is operated to control the settings of these functions.

The mode hand 65 points to one of the seven marks provided on the three o'clock side of the small window 4 to indicate the day of week. The mode hand 65 points to one of the marks provided on the nine o'clock side of the small window 4 to indicate a functional mode in action. The functional modes include a stopwatch mode, an alarm mode and a timer mode. Regarding the time display mode, summer saving time is indicated. An airplane mode can be turned on in parallel to these functional modes to prohibit transmission and reception of radiowaves associated with communication. The small window 4 indicates the airplane mode in the time display mode. Half of the small window 4 on the three o'clock side displays a hemisphere with ruled lines to indicate the latitude by the angle of the mode hand 65 from the three o'clock direction (horizontal direction).

The functional hands 66 and 67 indicate the activation of the functional modes in the small window 5. That is, the functional hands 66 and 67 indicate the time measured by the stopwatch or timer, the time set for the alarm, or the time at another point in the normal time display mode (world clock).

The 24-hour hand 68 makes one revolution in the small window 6 to indicate the time indicated by the hands 61 to 63 on a 24-hour dial, so that the user will know whether it is a.m. or p.m.

The crown C1 and the push-button switches B1, B2 and B3 are operated by the user. The crown C1 can be pulled out from the casing 2 in two steps. The crown C1 is pulled out and turned to set various parameters. The push-button switches B1 to B3 are each pushed to switch between corresponding functional modes and receive operation commands assigned to each functional mode.

Figure 2:
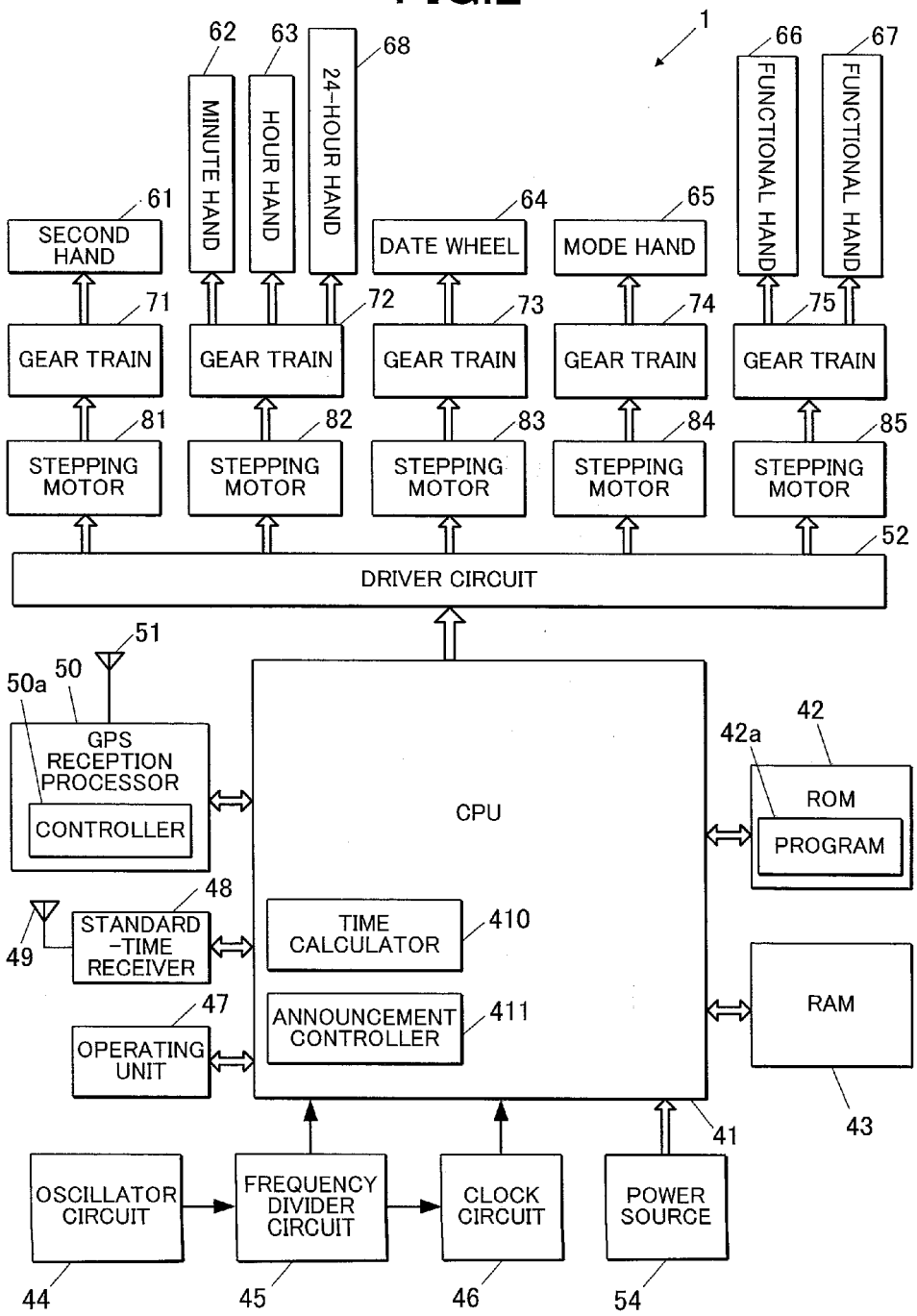
FIG. 2 is a block diagram illustrating the internal configuration of the analog electronic timepiece.

FIG. 2 is a block diagram illustrating the internal configuration of the analog electronic timepiece 1.

The analog electronic timepiece 1 includes hands 61 to 63, a date wheel 64, a mode hand 65, functional hands 66 and 67, a 24-hour hand 68, a central processing unit (CPU) 41 (a time calculator 410, a notification controller 411), a read only memory (ROM) 42, a random access memory (RAM) 43 (history storage unit), an oscillator circuit 44, a frequency divider circuit 45, a clock circuit 46, an operating unit 47, a standard-time receiver 48, an antenna 49 for the standard-time receiver 48, a GPS reception processor 50 (radiowave receiver), an antenna 51 for the GPS reception processor 50, a driver circuit 52, a power source 54, gear trains 71 to 75, and stepping motors 81 to 85.

The CPU 41 carries out calculation processes and comprehensively controls the entire operation of the analog electronic timepiece 1. The CPU 41 controls the hand movement to indicate current date and time, operates the standard-time receiver 48 to calculate the date and time from the received data, or operates the GPS reception processor 50 to acquire information on date and time. The CPU 41 also corrects the date and time counted by the clock circuit 46 on the basis of the acquired date and time data.

The ROM 42 stores programs 42*a* and setting data for the various control processes carried out by the CPU 41. The programs 42*a* include programs for controlling the operations in different functional modes, for example.

The RAM 43 provides a work space for the CPU 41 and stores temporary data. The RAM 43 also stores the history of acquired information on date, time, and position, and data on cities and the hand positions.

The oscillator circuit 44 generates and outputs predetermined frequency signals. The oscillator circuit 44 includes, for example, a crystal oscillator.

The frequency divider circuit 45 divides a frequency signal output from the oscillator circuit 44 into signals having frequencies usable in the CPU 41 and the clock circuit 46. The frequencies of the divided signals may be varied in response to control signals from the CPU 41.

The clock circuit 46 adds the frequency-divided signal from the frequency divider circuit 45 to the initial value indicating a predetermined date and time so as to count the current date and time. The date and time counted by the clock circuit 46 includes an error (rate of clock) of, for example, approximately 0.5 seconds per day, which corresponds to the accuracy of the oscillator circuit 44. The date and time counted by the clock circuit 46 can be corrected by the control signals from the CPU 41.

The operating unit 47 receives input operations from the user. The operating unit 47 includes the push-button switches B1, B2 and B3 and the crown C1. The pushing of the push-button switches B1, B2 and B3 and the pulling and pushing or turning of the crown C1 output electrical signals corresponding to the operations to the CPU 41.

The standard-time receiver 48 receives the radiowaves in a long wavelength range via the antenna 49, demodulates the amplitude-modulated time signal output (TCO) of the standard frequency and time, and outputs the demodulated output to the CPU 41. The tuning frequency in a long wavelength range from the standard-time receiver 48 is varied through the control of the CPU 41 in response to the transmission frequency from the transmitter station of the standard frequency and time to be received. The standard-time receiver 48 carries out various processes to enhance the receiving sensitivity, digitizes analog signals with a predetermined sampling frequency, and outputs the digitized signal to the CPU 41.

The GPS reception processor 50 receives radiowaves in the L1 band (1.57542 GHz for a GPS satellite) via the antenna 51, and decodes or deciphers the signals (navigation message data) through the demodulation of the transmitted radiowaves with a spread spectrum from a positioning satellite, which in this case is a positioning satellite (GPS satellite) in a global positioning system (GPS). Various calculation processes are carried out depending on the content of the deciphered navigation message data, and data in accordance with the request from the CPU 41 (target data) with a predetermined format is output to the CPU 41. The operation control involving reception, deciphering, calculation, and output is carried out by a controller 50*a* (microcomputer) provided in the GPS reception processor 50. The components involved in the reception by the GPS reception processor 50 are provided as a single module on a chip and connected to the CPU 41. The operation of the GPS reception processor 50 is turned on and off by the CPU 41 independent from the operation of the other components of the analog electronic timepiece 1. If the operation of the GPS reception processor 50 is not required, the analog electronic timepiece 1 cuts off the power supply to the GPS reception processor 50 to save electrical power.

The GPS reception processor 50 includes a storage unit. The storage unit includes a non-volatile memory, such as a flash memory or an electrically erasable and programmable read only memory (EEPROM). The content stored in the storage unit is held regardless of a power supply to the GPS reception processor 50. The storage unit can store various programs for operation control, information on the predicted orbits of the GPS satellites, and parameters associated with the acquisition of the date and time, e.g., correction values for leap seconds. The information on the predicted orbits may be stored in the RAM 43 of the analog electronic timepiece 1 and may be sent from the CPU 41 to the controller 50*a*, if required. The operation control programs may be stored in a special ROM, read at start-up, and loaded to the RAM of the controller 50*a*.

The power, source 54 supplies electricity with a predetermined voltage for the operation of the various components. The power source 54 includes batteries, such as a solar battery and a secondary battery. Alternatively, the power source 54 may include one or more replaceable button batteries. The power source 54 may output different voltages, for example, through a switching power supply that converts the voltage to a desired voltage.

The stepping motor 81 rotates the second hand 61 via the gear train 71, which consists of an array of multiple gears. Once the stepping motor 81 is operated, the second hand 61 turns by six degrees per step. The second hand 61 makes one revolution on the clock face 3 in 60 steps of the stepping motor 81.

The stepping motor 82 turns the minute hand 62, the hour hand 63, and the 24-hour hand 68 via the gear train 72. The gear train 72 turns the minute hand 62, the hour hand 63, and the 24-hour hand 68 in cooperation. The gear train 72 turns the minute hand 62 in increments of one degree, the hour hand 63 in increments of 1/12 degrees, and the 24-hour hand 68 in increments of 1/24 degrees. Thus, if the minute hand 62, the hour hand 63, and the 24-hour hand 68 turn every 10 seconds, the minute hand 62 makes one revolution in one hour on the clock face 3, the hour hand 63 moves by 30 degrees on the clock face 3, and the 24-hour hand 68 moves by 15 degrees in the small window 6. That is, the hour hand 63 makes one revolution in 12 hours on the clock face 3, and the 24-hour hand 68 makes one revolution in 24 hours in the small window 6.

The stepping motor 83 turns the date wheel 64 via the gear train 73. Once the stepping motor 83 is operated, the date wheel 64 rotates by an angle corresponding to a single step. The date wheel 64 rotates by 360/31 degrees in 150 steps, and the date indicator exposed through the opening 7 varies by an angle corresponding to one day. After the date wheel 64 turns by an angle corresponding to 31 days, the first date of the date indicator reappears through the opening 7.

The stepping motor 84 turns the mode hand 65 via the gear train 74. Once the stepping motor 84 is operated, the mode hand 65 turns by one degree per step. Thus, as the stepping motor 84 turns 360 times, the mode hand 65 makes one revolution in the small window 4.

The stepping motor 85 turns the functional hands 66 and 67 via the gear train 75. The gear train 75 turns the functional hands 66 and 67 in cooperation. The gear train 75 turns the functional hand 66 in increments of 6 degrees and the functional hand 67 in increments of ½ degrees. Thus, if the functional hands 66 and 67 turn every minute, the functional hand 66 makes one revolution in one hour in the small window 5, and the functional hand 67 moves by 30 degrees in the small window 5. That is, the functional hand 67 makes one revolution in 12 hours in the small window 5.

The hands 61 to 63, the date wheel 64, the mode hand 65, the functional hands 66 and 67, and the 24-hour hand 68 can turn by 90 pulses per second (pps) in the clockwise direction and 32 pps in the counterclockwise direction. That is, the hands that turn by one degree every time the stepping motor is operated (i.e., the minute hand 62 and the mode hand 65) can make one revolution in the clockwise direction in four seconds and in the counterclockwise direction in 11.25 seconds.

The driver circuit 52 outputs driving pulses of predetermined voltages to the stepping motors 81 to 85 in accordance with the control signals from the CPU 41. The driver circuit 52 can vary the length of the driving pulses (pulse width) in response to the condition of the analog electronic timepiece 1. If control signals for simultaneously driving multiple hands are received, the driver circuit 52 can delay the output timing of the driving pulses so as to reduce processing load.

The data acquisition on date, time, and position at the GPS reception processor 50 will now be described.

Figure 3:
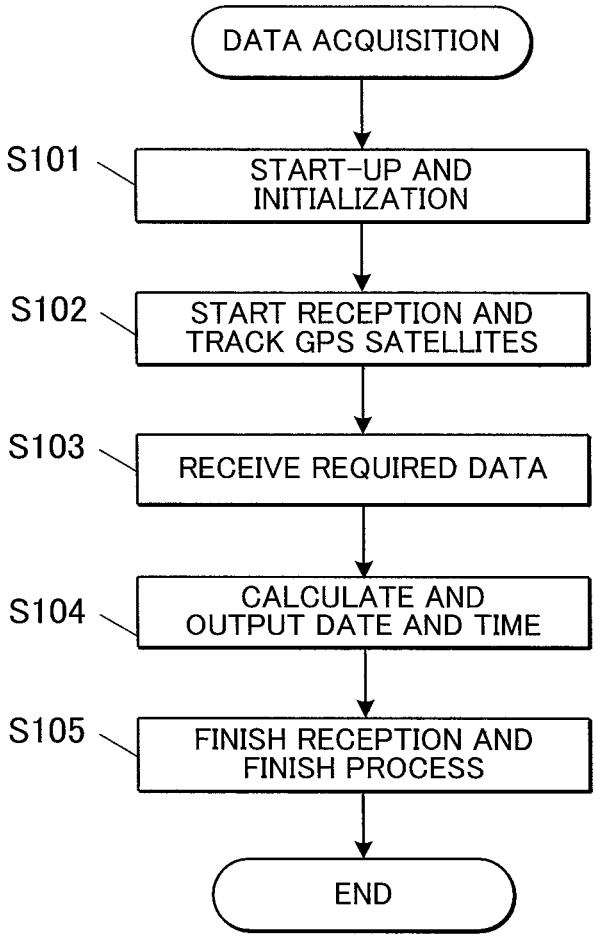
FIG. 3 is a flow chart illustrating the process of acquiring of date and time by a GPS reception processor.

FIG. 3 is a flow chart illustrating the data acquisition of date and time at the GPS reception processor 50.

The CPU 41 starts up the GPS reception processor 50 to start the acquiring process of the date and time.

After the start of the acquisition of date and time, the controller 50*a* of the GPS reception processor 50 carries out initialization for the start-up operation (Step S101). The controller 50*a* acquires parameters for the reception target and the reception process from the CPU 41, receives radiowaves from the GPS satellites, and executes programs for the acquisition of necessary information.

The controller 50*a* starts the reception of radiowaves from the GPS satellites, and tunes in to and detects the radiowaves so as to track the radiowaves (Step S102). After tracking the radiowaves from a required number of GPS satellites, the controller 50*a* receives necessary data from the tracked GPS satellites (Step S103). The controller 50*a* calculates the date and time on the basis of the received data and outputs the calculated date and time in a predetermined format to the CPU 41 (Step S104).

The controller 50*a* stops the reception of radiowaves from the GPS satellites, sends a request for power-off to the CPU 41 (Step S105), and finishes the acquisition process on the date and time.

The acquisition process on the positional information (positional information acquisition process) is identical to the acquisition process on the date and time, except that the current position is calculated and output together with the date and time in Step S104.

The time required for the steps in the acquisition process on the date and time and the acquisition process on the position will now be described.

In Step S101, the reception of radiowaves from the GPS satellites first requires the start-up of the GPS reception processor 50. This process (start-up time) probably requires a substantially constant time in the analog electronic timepiece 1.

In Step S102, the GPS reception processor 50 tracks the radiowaves from the GPS satellites. The navigation messages are transmitted from the GPS satellites after the spectral spread with a C/A code inherent in each GPS satellite and modulation with carrier waves. Tracking of the radiowaves from the GPS satellites and reception of these navigation messages involve tuning of the receiver to the frequency of the radiowaves sent from the GPS satellites, from which the messages can be received, and modulation of the spread spectrum received radiowave signals with the C/A code corresponding to the GPS satellite.

The GPS satellites orbit the Earth at high speed and are subjected to the Doppler effect that causes the reception frequency to vary from the transmission frequency due to the speed of the GPS satellites relative to the reception point in the travelling direction. If the positions of the GPS satellites (orbit information) are unknown, the reception frequency must be scanned within a variable range due to the Doppler effect.

If the positions of the GPS satellites are unknown, the receiver cannot determine the receivable (visible) state of reception of radiowaves from the GPS satellite at the reception point. Thus, the signals must be detected through the modulation of the spread spectrum with the C/A code of every GPS satellite.

The time required for the tracking of the radiowaves from the GPS satellites (tracking time) depends on the availability of the satellite positions (predicted orbit data) by the GPS reception processor 50. In practice, a longer tracking time may be required if only a small number of GPS satellites transmit radiowaves receivable in the reception environment or if the transmitted radiowaves have low intensity.

If radiowaves on only the date and time information are received from only one GPS satellite, the date and time information can be acquired within a range of an error caused by an undefined distance between the GPS satellite and the reception point. Exact positioning with the GPS satellites (including positioning without the above-mentioned error in the date and time) requires the radiowaves from four GPS satellites. Thus, the time required for the tracking of the radiowaves from a required number of GPS satellites varies depending on the number of satellites.

After tracking the radiowaves from the GPS satellites, the GPS reception processor 50 receives the navigation messages required for the acquisition of the date and time, and decodes or deciphers the navigation messages (Step S103).

Figure 4:
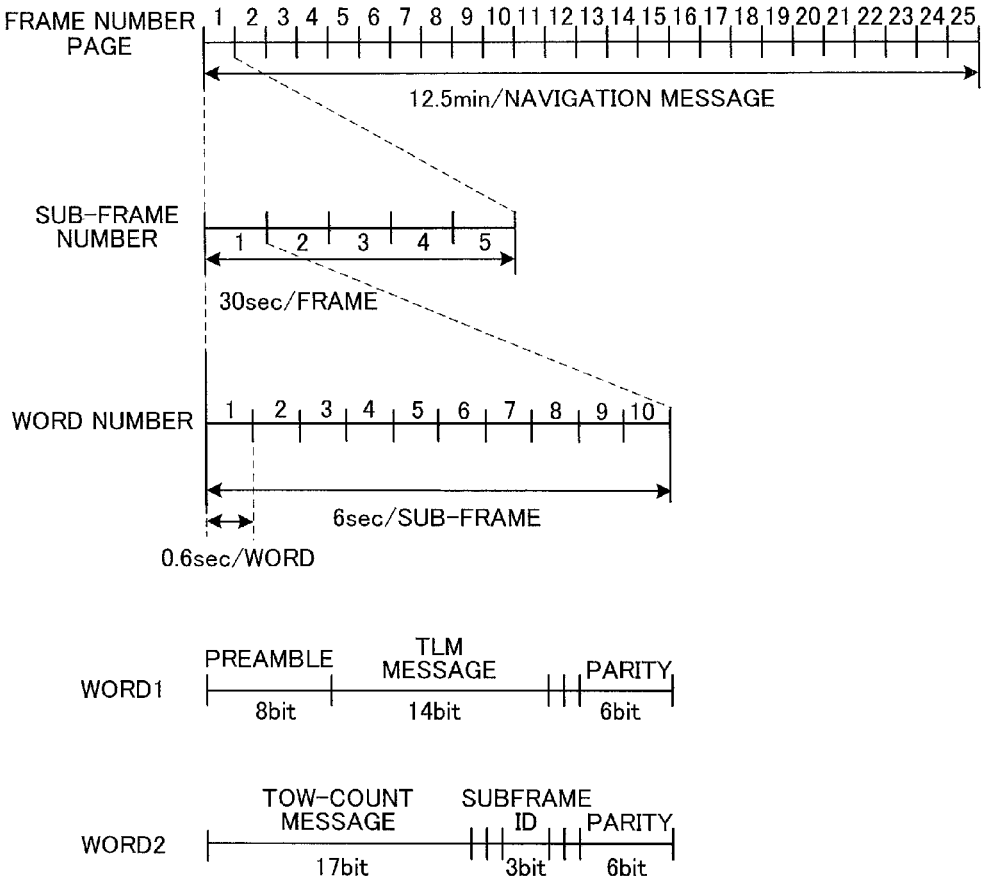
FIG. 4 illustrates the format of a navigation message sent from a GPS satellite.

FIG. 4 illustrates the format of the navigation messages sent from the GPS satellites.

The navigation messages sent from the GPS satellites each consists of 25 30-second frames. Each frame includes five six-second sub-frames. Each sub-frame includes ten 0.6-second words.

Each word consists of 30 bits. The formats of words 1 and 2, which are the first and second words of each sub-frame in, are the same in all the sub-frames. The leading 22 bits in word 1 represent a telemetry (TLM) word. The leading eight bits of the 22 bits represent a fixed preamble. The leading 22 bits in word 2 represent a handover word HOW. The leading 17 bits of the 22 bits represent a time-of-week TOW count indicating the time elapsed from Sunday.

The content of word 3 and the subsequent words differs in every sub-frame. The leading 10 bits in word 3 of the leading sub-frame (sub-frame 1) indicate a week number WN. Words 3 and the subsequent words in sub-frames 2 and 3 include orbit data (ephemeris data) of the relevant GPS satellites. Word 3 and the subsequent words in sub-frame 4 include various correction parameters for the determination of position, date, and time. Word 3 and the subsequent words in sub-frame 5 include the predicted orbit data (almanac data) for all the GPS satellites.

A combination of the week number WN and the time-of-week TOW count derives information on the date and time. That is, the date and time data can be output after the reception of sub-frame 1.

The acquisition of positional information requires the date and time and the ephemeris data from at least four GPS satellites. Usually, correction parameters and almanac data are also acquired at the same time. Thus, the position can be calculated and output through the acquisition of data corresponding to a single frame. The analog electronic timepiece 1 according to this embodiment can acquire data sets in parallel from multiple satellites.

That is, the reception time period is different for date and time data and positional data.

The GPS reception processor 50 of the analog electronic timepiece 1 according to this embodiment can acquire partial information on the date and time, e.g., the date data, from an external unit, which is the CPU 41 in this case. With this date stored, the GPS reception processor 50 can acquire the time-of-week TOW count so as to calculate the date and time on the basis of the time component of the time-of-week TOW count and the stored date data. Alternatively, the GPS reception processor 50 can back-calculate the week number WN from the time-of-week TOW count and the stored date data and calculate the date and time from this week number WN and the time-of-week TOW count.

If the week number WN and the time-of-week TOW count are both received with the date data stored, the stored date data is updated with the new date data determined from the week number WN and the time-of-week TOW count.

The history of the date and time information acquired by the GPS reception processor 50 and the standard-time receiver 48 can be stored in the RAM 43. If this history suggests that the date and time counted by the clock circuit 46 is relatively accurate, e.g., if the date and time have been updated within one month, the date data can be sent from the CPU 41 to the GPS reception processor 50, and only the time-of-week TOW count can be received without reception of the week number WN. Changing the acquisition way of the date data, which is the target data, (method of acquiring date data) can reduce the time required for the reception of necessary navigation messages from the GPS satellites (data reception time).

The time-of-week TOW count can be acquired through the acquisition of one of the sub-frames or, more specifically, word 2 of one of the sub-frames. The length of a sub-frame is six seconds as described above. Thus, the minimum time required for the reception of a complete sub-frame is 6 seconds. The reception, however, takes up to approximately 12 seconds depending on the start time of the reception because the preamble must be preliminarily received to identify the beginning of a sub-frame. Similarly, the preamble must be received in advance of the reception of word 2 so as to acquire the target. Thus, the minimum time required for the reception of words 1 and 2 is 1.2 seconds. The reception, however, takes up to 7.2 seconds, which corresponds to 12 words, depending on the start time of the reception. An appropriate way may be selected from these reception ways on the basis of the accuracy of the date and time to be counted by the clock circuit 46 (rate of clock) or the time from the last correction. Alternatively, the reception may be uniformly set for approximately one sub-frame. If the position of the target data in the navigation messages is unknown, the data reception time is set to the minimum time. If the data position can be estimated, a minimum waiting time may be added to the data reception time in consideration of the estimation error.

The reception of a complete frame for positioning from the beginning to the end requires a minimum time of 30 seconds and a maximum time of just below 60 seconds. If data corresponding to one frame is received from an n-th intermediate sub-frame of one frame to an (n−1)-th intermediate sub-frame of the next frame (where n is an integer greater than one), the maximum reception time is just below 36 seconds.

If the error in the date and time counted by the clock circuit 46 is presumed to be sufficiently smaller than the length of the sub-frame (six seconds), the controller 50*a* may interrupt the reception of radiowaves after tracking of the radiowaves from the GPS satellites and storing of the reception frequency of the radiowaves and C/A codes (satellite numbers) until immediately before the estimated transmission timing of word 1. This interruption time may be added to the data reception time.

After the acquisition of the necessary navigation messages, the controller 50*a* calculates the date and time (Step S104). The date and time can be readily determined from the stored date data, the week number WN, and the time-of-week TOW count. The processing time required for the determination of the date and time is significantly short compared to the time required for other processes and thus can be ignored. Although the time required for the calculation of the position in the positioning process is longer than the time required for calculating the date and time, it is still significantly short compared to the time required for other processes and thus can be ignored.

The time, from start-up of the GPS reception processor 50, required for the CPU 41 to receive the date and time information or the positional information from the GPS reception processor 50 in operation is at least the sum of the start-up time of the GPS reception processor 50, the tracking time, and the data reception time. In the analog electronic timepiece 1 according to this embodiment, the CPU 41 determines the smallest sum as a minimum turnaround time (turnaround time) estimated on the basis of the target data, the reception timing, the date and time data stored in the clock circuit 46, and the reception conditions, and then the GPS reception processor 50 starts the process of receiving radiowaves containing the date and time information or the positional information.

The movement of the hands during the reception of the date and time information or the positional information by the GPS reception processor 50 will now be described.

The position is indicated by the mode hand 65. During acquisition of positional information, the mode hand 65 repeats a predetermined patterned movement of fast-forward motions (notification) that indicate acquisition of positional information. The fast-forward motion of the mode hand 65 causes frequent transmission of control signals from the CPU 41 to the driver circuit 52. If an interruption process for the reception of date and time information from the GPS reception processor 50 overlaps with the output of a control signal, the start of the interruption process will be delayed, causing a shift in the synchronization point of the date and time (the beginning of the seconds component of the date and time). Thus, in the analog electronic timepiece 1 according to this embodiment, the fast-forward motion of the mode hand 65 is stopped before the earliest interruption for the reception of date and time information. The movement of the hands 61 to 63 and the 24-hour hand 68 is also stopped before this interruption. Alternatively, the movement of the hands 61 to 63 and the 24-hour hand 68 may be stopped upon the start of the acquisition of date and time.

FIGS. 5A to 5E illustrate the movement of a hand in the small window 4 of the analog electronic timepiece 1 during the acquisition of positional information. FIG. 6 illustrates the position, moving direction, and moving rate (speed) of the mode hand 65.

Figure 5A:
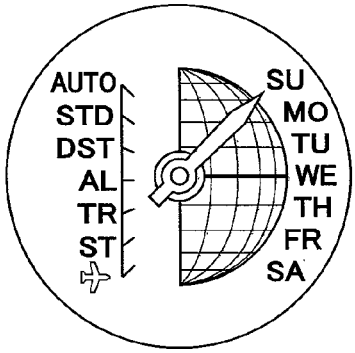
FIGS. 5A to 5E illustrate example movements of a hand during acquisition of positional information.
Figure 6:
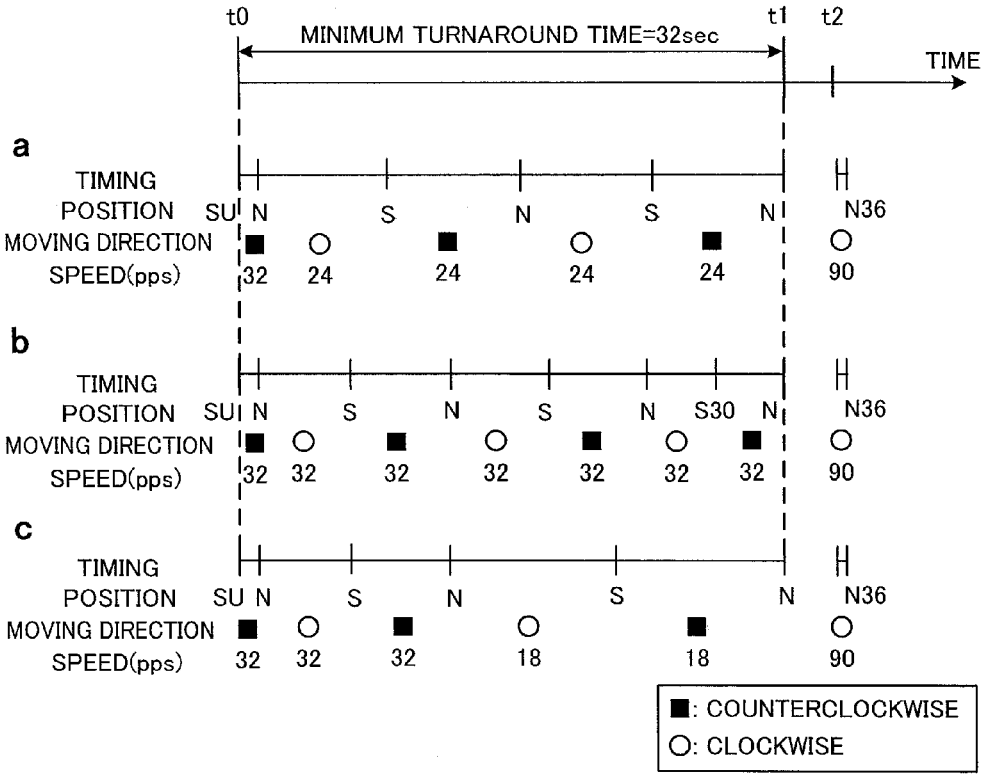
FIG. 6 illustrates the position, moving direction, and moving rate of a mode hand.

With reference to FIG. 5A, in a normal state, the mode hand 65 indicates the day of the week in the time display mode. In the drawing, the mode hand 65 points to the marker SU corresponding to "Sunday."

Figure 5B:
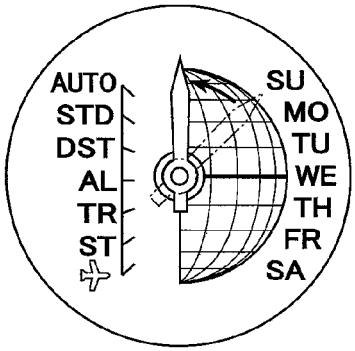

With reference to FIG. 5B, after the CPU 41 starts the positioning process and a command for the acquisition of positional information is sent to the GPS reception processor 50 (timing t0 in FIG. 6), the mode hand 65 points directly upward, i.e., to a latitude of 90 degrees north. This movement is than 180 degrees or less (moving angle) within half of the small window 4 on the three o'clock side. That is, the mode hand 65 moves in the counterclockwise direction. The moving rate (operating rate) is 32 pps maximum.

Figure 5C:
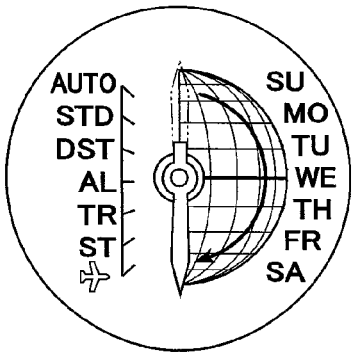

After the mode hand 65 points to a latitude of 90 degrees north, the mode hand 65 moves in the opposite or clockwise direction, as illustrated in FIG. 5C. The mode hand 65 moving in the clockwise direction points directly downward, i.e., to a latitude of 90 degrees south. The moving rate in the clockwise direction is preferably the same as that in the counterclockwise direction, which is 32 pps maximum.

Figure 5D:
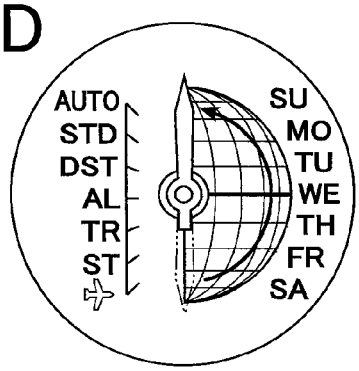

After the mode hand 65 points to a latitude of 90 degrees south, the mode hand 65 moves in the opposite or counterclockwise direction for a second time and points to a latitude of 90 degrees north, as illustrated in FIG. 5D. The moving rate is preferably the same as before.

With reference to FIG. 6, the mode hand 65 moves between a latitude of 90 degrees north (position N) and a latitude of 90 degrees south (position S) during the minimum turnaround time (until timing t1). If the mode hand 65 stops at an intermediate position at the end of the minimum turnaround time, this position may be misidentified as the measured latitude. Thus, the moving rate is adjusted such that the mode hand 65 stops at a predetermined position (reference position), which is a latitude of 90 degrees north in this case. If the minimum turnaround time is 32 seconds, the mode hand 65 can moves to position N at 32 pps and reciprocate between the positions N and S two times at a constant rate of 24 pps, as illustrated in section a of FIG. 6.

Alternatively, as illustrated in section b of FIG. 6, the mode hand 65 can reciprocate at a constant rate of 32 pps until one step before the mode hand 65 stops and move in an opposite direction at an intermediate position (which is a latitude of 30 degrees south (S30) in this case), instead of moving through to position S. As a result of such movement, the mode hand 65 can reach a latitude of 90 degrees north at the end of the minimum turnaround time.

Alternatively, as illustrated in section c of FIG. 6, the mode hand 65 can move at a constant rate of 32 pps until one step before the mode hand 65 stops and slow down to a lower constant rate (which is 18 pps in this case) such that the mode hand 65 reaches a latitude of 90 degrees north at the end of the minimum turnaround time.

Figure 5E:
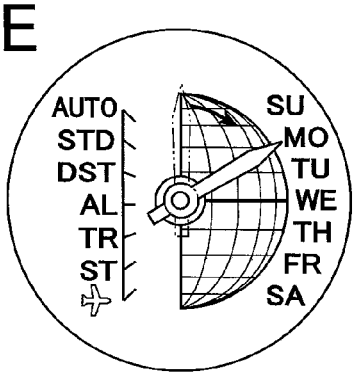

With reference to FIG. 6, after the mode hand 65 stops and the positional information is sent from the GPS reception processor 50 to the CPU 41 (at timing t2), the CPU 41 moves the mode hand 65 to a position indicating the latitude of the determined position (which is, for example, a latitude of 36 degrees north (N36) as illustrated in FIG. 5E). This time the mode hand 65 moves at the maximum rate of 90 pps so that the user can notice that the position is indicated.

Figure 7:
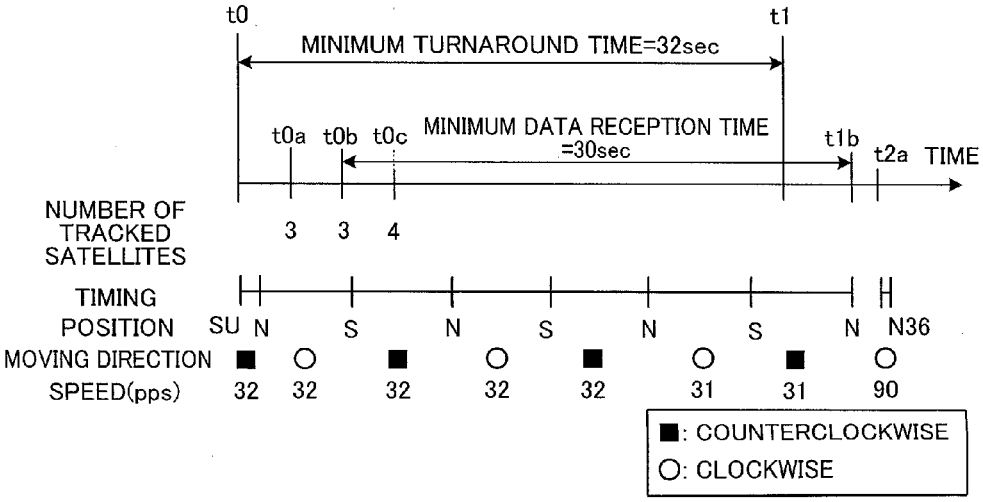
FIG. 7 illustrates the position, moving direction, and moving rate of a mode hand.

FIG. 7 illustrates the position, the moving direction, and the moving rate of the mode hand 65 when a certain time is required for the tracking of the GPS satellites.

If it is difficult to track the necessary number of GPS satellites within the minimum turnaround time, the GPS reception processor 50 cannot acquire the date and time and the result of the positioning immediately after the minimum turnaround time in some cases. If the mode hand 65 remains stationary for too long in such a case, the user may suspect malfunction of the analog electronic timepiece 1. To avoid such misconception, the analog electronic timepiece 1 according to this embodiment acquires the number of GPS satellites being tracked by the GPS reception processor 50 (tracking data) at predetermined time intervals starting from the start-up of the GPS reception processor 50 and determines the start of the required data reception (Step S103) (at timing t0*a*, tab, and t0*c*). If the remaining operating time of the mode hand 65 is shorter than the minimum data reception time (timing t0*a* and t0*b*) before the tracking of the necessary number of GPS satellites, the remaining operating time is extended to the minimum data reception time. This extension can reduce the time required from the stopping of the mode hand 65 (timing t1*b*) to the input of the acquired data (timing t2*a*).

With reference to FIG. 7, the time intervals are three seconds. Alternatively, the time intervals may be set to 0.6 seconds, which corresponds to a word, or six seconds, which corresponds to a sub-frame.

Figure 8:
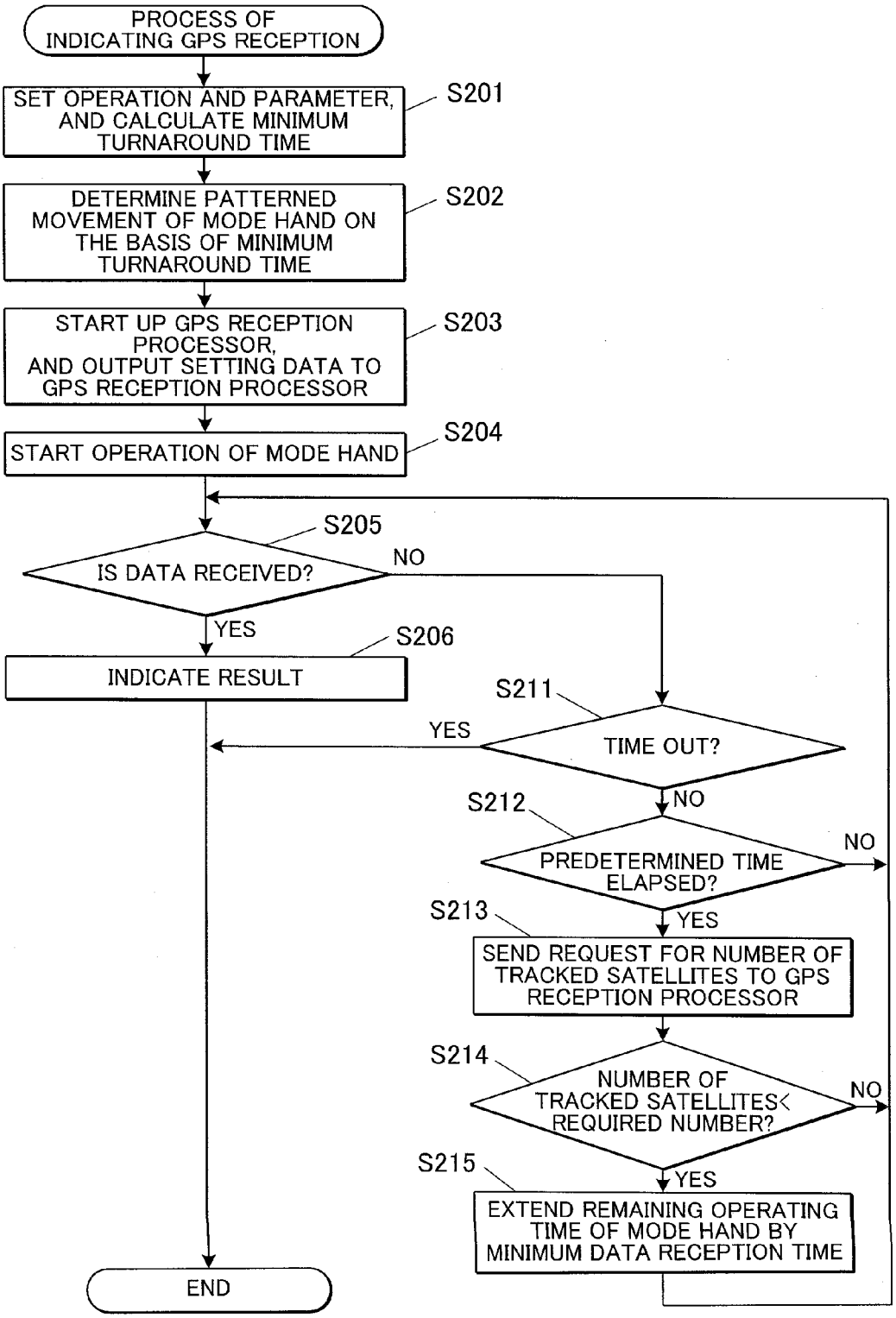
FIG. 8 is a flow chart illustrating the control process of indicating GPS reception.

FIG. 8 is a flow chart illustrating the control process of indicating GPS reception carried out by the CPU 41 of the analog electronic timepiece 1. For the acquisition of date and time, this process is initiated in response to an automatic call under predetermined conditions or an input operation by the user. For the acquisition of position, the process is initiated in response to a predetermined input operation by the user.

Upon start of the process of indicating GPS reception, the CPU 41 establishes the operation, such as the acquisition of date and time and positioning, and assigns the parameters to be output to the GPS reception processor 50 and calculates the minimum turnaround time from the operation and the parameters (Step S201). The CPU 41 determines the patterned movement to be carried out by the mode hand 65 on the basis of the calculated minimum turnaround time (Step S202).

The CPU 41 starts up the GPS reception processor 50, sends the parameters to the GPS reception processor 50 (Step S203), and outputs a control signal to the driver circuit 52 to start the operation of the mode hand 65 (Step S204). The control signal is output during the minimum turnaround time, executed in parallel with other control operations for the process of indicating GPS reception, and then ends.

The CPU 41 determines the proper reception of data from the GPS reception processor 50 (Step S205). If data is received (YES in Step S205), a control signal is sent to the driver circuit 52 based on the received data, and the result is indicated by the hand (Step S206). The CPU 41 finishes the process of indicating GPS reception.

If data is not received properly from the GPS reception processor 50 (NO in Step S205), the CPU 41 determines the reception of a time-out signal indicating the failure of the tracking of GPS satellites from the GPS reception processor 50 or a predetermined time limit for non-reception of signals (Step S211). If the CPU 41 determines the time-out signal or the time limit (YES in Step S211), the CPU 41 finishes the process of indicating GPS reception.

The time-out signal may be sent during the minimum turnaround time. A delay in the time-out signal has no adverse effect.

If the CPU 41 does not determine the time-out signal or the time limit (NO in Step S211), the CPU 41 determines the end of a predetermined time after the start of the process of indicating GPS reception or after the previous predetermined time (Step S212). If the predetermined time has not elapsed (NO in Step S212), the CPU 41 performs Step S205.

If the predetermined time has elapsed (YES in Step S212), the CPU 41 sends a request for the number of tracked GPS satellites to the GPS reception processor 50 (Step S213). The CPU 41 waits for the information from the GPS reception processor 50.

After the information is sent from the GPS reception processor 50, the CPU 41 determines whether the number of tracked GPS satellites is less than the number required for operation (Step S214). If the number is not less than the required number of GPS satellites (NO in Step S214), the CPU 41 performs Step S205.

If the number is less than the required number of GPS satellites (YES in Step S214), the CPU 41 refers to the remaining operating time and extends this by the minimum time required for data acquisition if the remaining operating time is less than the minimum time required for data acquisition (Step S215). The CPU 41 then performs Step S205.

[Modifications]

FIGS. 9A to 9E illustrate a small window 4 according to a modification of this embodiment and the movement of the mode hand 65 in this small window 4.

The small window 4 displays the globe with latitude and longitude in the central area. The mode hand 65 indicates the latitude and longitude within the 360 degrees around the illustrated globe.

Figure 9A:
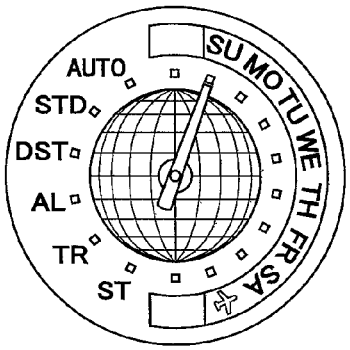
FIGS. 9A to 9E illustrate a modification of the movement of the mode hand.

With reference to FIG. 9A, the mode hand 65 points to the marker SU corresponding to "Sunday" to indicate the day of the week.

Figure 9B:
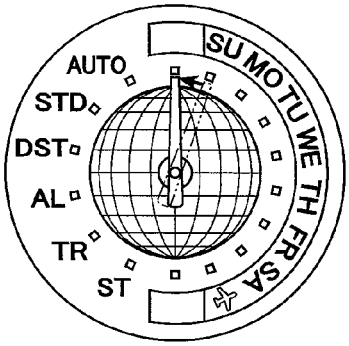
Figure 9C:
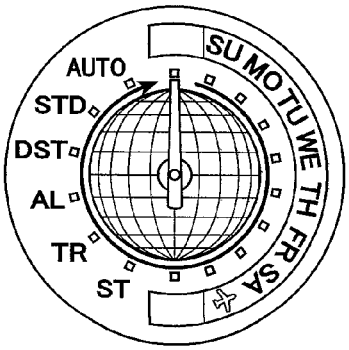
Figure 9D:
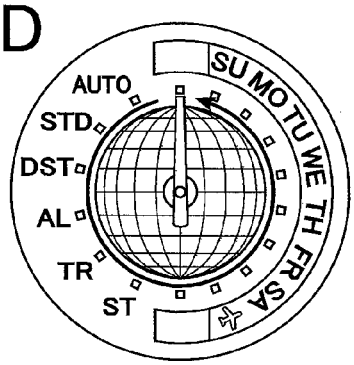
Figure 9E:
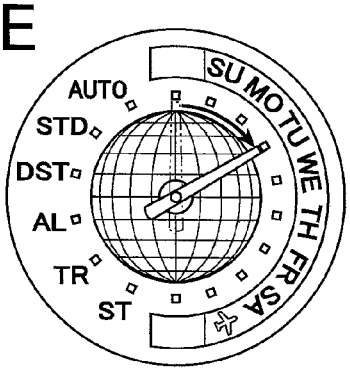

With reference to FIG. 9B, after the start of the process of indicating GPS reception, the mode hand 65 fast-forwards counterclockwise (at 32 pps) to the 12 o'clock position. With reference to FIG. 9C, the mode hand 65 fast-forwards clockwise by 360 degrees at 32 pps and returns to the 12 o'clock position. With reference to FIG. 9D, the mode hand 65 fast-forwards counterclockwise by 360 degrees at 32 pps to return to the 12 o'clock position. The mode hand 65 repeats these movements for the minimum turnaround time and then stops. After the data is sent from the GPS reception processor 50 to the CPU 41, the mode hand 65 moves to a position indicating the received data, as illustrated in FIG. 9E. The mode hand 65 may constantly move in the clockwise direction at 90 pps to point to the target position. Alternatively, the mode hand 65 may move at a maximum rate in a direction that achieves accession of the mode hand to the target position in the shortest time.

As described above, the analog electronic timepiece 1 according to this embodiment includes: a GPS reception processor 50 that receives radiowaves from GPS satellites, calculates the date, time, and/or positional data assigned in advance as target data based on the navigation messages decoded or deciphered from the received radiowave, and outputs the calculated data to a CPU 41; and a rotatable mode hand 65. The CPU 41 calculates the turnaround time from the input of a command for radiowave reception from the CPU 41 to the GPS reception processor 50 to the output of the target data to the CPU 41, moves the mode hand 65 in accordance with a predetermined patterned movement during the reception of the radiowaves, and finishes the movement of the mode hand 65 after the calculated turnaround time.

That is, the analog electronic timepiece 1 can reliably inform the user of the receiving mode of radiowaves by continuing the patterned movement of the mode hand 65 during the reception of the radiowaves, and can maintain the accuracy of the date and time data received as radiowaves because the mode hand 65 finishes the patterned movement before the reception of the date and time data and/or the positional data from the GPS reception processor 50.

The mode hand 65 stops at the 12 o'clock position or a reference position pointing to the north pole in the small window 4 at the end of the patterned movement. Thus, the mode hand 65 is not misidentified as the indication of a position. The mode hand 65 then indicates the determined position on the 3 o'clock side between the 12 and 6 o'clock positions. This can be achieved by constant clockwise fast-forwarding without a long wait of the user.

The turnaround time includes the start-up time from the input of a command for radiowave reception to the GPS reception processor 50 to the start of the actual reception by the GPS reception processor 50; the tracking time from the start of the reception to the tracking of the radiowaves from the necessary number of GPS satellites by the GPS reception processor 50; and the data reception time determined depending on the type of the target data, such as date and time data and positional data, and the acquisition way of the data. The appropriate establishment of these times, which constitute a significant portion of the turnaround time, can prevent the mode hand 65 from continuing to move even after the input of data from the GPS reception processor 50 to the CPU 41 and reduce the waiting time for the indication of the received data after the end of the turnaround time.

The CPU 41 receives tracking information on the number of GPS satellites being tracked during the reception of radiowaves by the GPS reception processor 50 at predetermined time intervals. If the number of tracked GPS satellites is less than the number necessary for the acquisition of the date and time data and positional data, the CPU 41 resets the turnaround time such that the turnaround time includes the data reception time upon the acquisition of the tracking information and instructs the mode hand 65 to follow a predetermined patterned movement until the end of the reset turnaround time. If the capture of the radiowaves from the GPS satellites requires time due to a poor reception environment for the radiowaves, the time for the patterned movement carried out by the mode hand 65 is appropriately extended depending on the tracking time. The patterned movement reduces the waiting time from the end of the patterned movement to the indication of the received data and thus prevents the user from suspecting the malfunction of the analog electronic timepiece 1.

The RAM 43 stores the reception history. The CPU 41 can appropriately use the date and time counted by the clock circuit 46 depending on the latest reception of radiowaves, i.e., updating of date and time data, to calculate the date, time, and position with a reduction in load of data reception from the GPS satellites. The CPU 41 can reduce the data reception time depending on the necessary target data so as to reduce power consumption by the GPS reception processor 50, can reduce the waiting time for the user, and can instruct the mode hand 65 to follow a patterned movement having an appropriate duration corresponding to the reduction in the waiting time.

If the turnaround time is estimated to finish during the patterned movement repeated by the mode hand 65 during reception of radiowaves, at least the moving rate or the moving angle of the mode hand 65 is changed so as to reduce or extend the time required for completing the patterned movement at least once such that the patterned movement finishes at the end of the turnaround time. In this way, if the mode hand 65 stops at an intermediate position even for a short time, it is possible to more surely eliminate the possibility that the user will suspect the malfunction of the analog electronic timepiece 1 or misidentify the mode hand 65 as the indication of a position.

The moving rate of the mode hand 65 can be set such that the moving rate for the indication of the determined time, date, and position is greater than the moving rate in the patterned movement during the reception of radiowaves so as to inform the user of the indication of the received data and reduce the time required for the indication without a long wait of the user.

The present invention should not be limited to the embodiments described above and can include various modifications.

For example, if the start of the reception of positional data in a target frame or sub-frame can be calculated, as described above, the waiting time until the start of reception can be added to the minimum turnaround time. If the start-up time included in the minimum turnaround time is sufficiently shorter than the other time components in the minimum turnaround time, the start-up time can be omitted from the calculation without causing a large negative effect on the end timing of the movement of the mode hand 65.

The target data should not limited to the navigation messages from the GPS satellites. Alternatively, the target data may be navigation messages from other positioning satellites, for example, positioning satellites in a GLONASS.

In the embodiment described above, the mode hand 65 moves to indicate the reception of radiowaves. Alternatively, one or more other hands may indicate the reception. The patterned movements may be appropriately changed depending on the fast-forward speed and the turning angle of the hands in each step.

In the embodiment described above, the same patterned movement is repeated at different moving rates except for the movement for time adjustment at the end of the patterned movement. The patterned movement may differ every time so long as the user can readily recognize the pattern.

For example, the patterned movement of the mode hand 65 can be changed depending on the number of tracked satellites. For example, with reference to section a in FIG. 6, for three tracked satellites after the mode hand 65 moves to position N at 32 pps, the moving rate of the hand may be reduced by half the normal rate, 12 pps, and the moving angle reduced to half the normal range (such that the hand reciprocates between the position N and a latitude of zero degrees), and the hand may then reciprocate between positions N and S at a constant moving rate of 24 pps. A change in the patterned movement through a change in at least the moving rate or the moving angle can inform the user of normal tracking of the GPS satellites without problems.

In this embodiment, the mode hand 65 stops at a latitude of 90 degrees north after the end of the minimum turnaround time. Alternatively, the mode hand 65 may stop at any other position. The mode hand 65 pointing to an intermediate position in the range for the indication of the acquired data, which is between latitudes of 90 degrees north and south (on the three o'clock side) in this case, cannot be readily identified as either indication of the acquired data or a stand-by mode. Thus, it is preferred that the mode hand 65 stop at a latitude of 90 degrees north or south at a position on the nine o'clock side. The mode hand 65 stopped at a latitude of 90 degrees north, rather than south, or a position near 90 degrees north (slightly in the counterclockwise direction) can move at high speed in the clockwise direction to a position indicating the acquired data. Alternatively, the mode hand 65 may stop at either a latitude of 90 degrees north or south, whichever is a position that is readily approachable without a large movement within the minimum turnaround time.

In this embodiment, the tracking information from the satellites is repeatedly acquired during the reception of radiowaves. If it is not a problem to lose the satellites after the tracking, the acquisition of the tracking information may be stopped after the tracking of radiowaves from a necessary number of GPS satellites. If radiowaves from satellites are successfully tracked every time based on the reception history, the acquisition of the tracking information may be cancelled.

In this embodiment, the mode hand 65 moves at different fast-forwarding rates: 32 pps to indicate the reception during the process of indicating GPS reception and 90 pps to indicate the acquired data. Alternatively, the fast-forwarding rates may be identical. The fast-forwarding rates of the mode hand 65 may differ between the clockwise and counterclockwise directions. Alternatively, the fast-forwarding rate in the same direction may be varied appropriately depending on the number of satellites tracked during the fast-forward motion and the time required for the reception of radiowaves.

The specific contents described in the embodiments, such as the configurations and control processes, may be modified appropriately within the scope of the invention.

Though several embodiments of the present invention have been described above, the scope of the present invention is not limited to the above embodiments, and includes the scope of inventions, which is described in the scope of claims, and the scope equivalent thereof.

The entire disclosure of Japanese Patent Application No. 2014-057548 filed on Mar. 20, 2014 including description, claims, drawings, and abstract are incorporated herein by reference in its entirety.

What is claimed is:

1. An analog electronic timepiece comprising:

a radiowave receiver that receives radiowaves from positioning satellites, acquires preassigned target data from the received radiowaves and outputs the acquired target data;

a hand that is provided to be rotatable;

a time calculator that calculates a turnaround time from input of a reception command for the radiowaves to the radiowave receiver to output of the acquired target data; and a notification controller that instructs the hand to carry out a predetermined notification movement during reception of the radiowaves and finish the notification movement at a timing when the turnaround time elapses.

2. The analog electronic timepiece according to claim 1, wherein the notification controller stops the hand at a predetermined reference position when the notification movement is finished.

3. The analog electronic timepiece according to claim 1, wherein the turnaround time includes:

(i) a predetermined start-up time from the input of the reception command to the radiowave receiver to start of the reception by the radiowave receiver;

(ii) a tracking time required for tracking the radiowaves from the positioning satellites which are required for the radiowave receiver to acquire the target data from the start of the reception; and (iii) a data reception time determined in accordance with the target data and an acquisition way of the target data.

4. The analog electronic timepiece according to claim 2, wherein the turnaround time includes:

(i) a predetermined start-up time from the input of the reception command to the radiowave receiver to start of the reception by the radiowave receiver;

(ii) a tracking time required for tracking the radiowaves from the positioning satellites which are required for the radiowave receiver to acquire the target data from the start of the reception; and (iii) a data reception time determined in accordance with the target data and an acquisition way of the target data.

5. The analog electronic timepiece according to claim 3, wherein the notification controller:

(i) acquires tracking information on a number of the positioning satellites being tracked by the radiowave receiver at predetermined time intervals from the radiowave receiver;

(ii) resets the turnaround time so that the turnaround time includes the data reception time from an acquisition timing of the tracking information if the number of the tracked positioning satellites is less than a number of the positioning satellites required for the radiowave receiver to acquire the target data; and (iii) instructs the hand to carry out the notification movement until a timing corresponding to elapsed time of the reset turnaround time.

6. The analog electronic timepiece according to claim 4, wherein the notification controller:

(i) acquires tracking information on a number of the positioning satellites being tracked by the radiowave receiver at predetermined time intervals from the radiowave receiver;

(ii) resets the turnaround time so that the turnaround time includes the data reception time from an acquisition timing of the tracking information if the number of the tracked positioning satellites is less than a number of the positioning satellites required for the radiowave receiver to acquire the target data; and (iii) instructs the hand to carry out the notification movement until a timing corresponding to elapsed time of the reset turnaround time.

7. The analog electronic timepiece according to claim 3, further comprising a history storage unit that stores reception history, wherein the notification controller sets the acquisition way based on the reception history and determines the data reception time corresponding to the acquisition way.

8. The analog electronic timepiece according to claim 4, further comprising a history storage unit that stores reception history, wherein the notification controller sets the acquisition way based on the reception history and determines the data reception time corresponding to the acquisition way.

9. The analog electronic timepiece according to claim 5, further comprising a history storage unit that stores reception history, wherein the notification controller sets the acquisition way based on the reception history and determines the data reception time corresponding to the acquisition way.

10. The analog electronic timepiece according to claim 6, further comprising a history storage unit that stores reception history, wherein the notification controller sets the acquisition way based on the reception history and determines the data reception time corresponding to the acquisition way.

11. The analog electronic timepiece according to claim 1, wherein the notification movement of the hand includes repetition of a predetermined patterned movement; and if the turnaround time elapses during the patterned movement, the notification controller changes at least one of a moving rate and a moving angle of the hand of the patterned movement, and reduces or extends a time required for at least one patterned movement so as to finish the last patterned movement at a timing when the turnaround time elapses.

12. The analog electronic timepiece according to claim 2, wherein the notification movement of the hand includes repetition of a predetermined patterned movement; and if the turnaround time elapses during the patterned movement, the notification controller changes at least one of a moving rate and a moving angle of the hand of the patterned movement, and reduces or extends a time required for at least one patterned movement so as to finish the last patterned movement at a timing when the turnaround time elapses.

13. The analog electronic timepiece according to claim 3, wherein the notification movement of the hand includes repetition of a predetermined patterned movement; and if the turnaround time elapses during the patterned movement, the notification controller changes at least one of a moving rate and a moving angle of the hand of the patterned movement, and reduces or extends a time required for at least one patterned movement so as to finish the last patterned movement at a timing when the turnaround time elapses.

14. The analog electronic timepiece according to claim 4, wherein the notification movement of the hand includes repetition of a predetermined patterned movement; and if the turnaround time elapses during the patterned movement, the notification controller changes at least one of a moving rate and a moving angle of the hand of the patterned movement, and reduces or extends a time required for at least one patterned movement so as to finish the last patterned movement at a timing when the turnaround time elapses.

15. The analog electronic timepiece according to claim 5, wherein the notification movement of the hand includes repetition of a predetermined patterned movement; and if the turnaround time elapses during the patterned movement, the notification controller changes at least one of a moving rate and a moving angle of the hand of the patterned movement, and reduces or extends a time required for at least one patterned movement so as to finish the last patterned movement at a timing when the turnaround time elapses.

16. The analog electronic timepiece according to claim 6, wherein the notification movement of the hand includes repetition of a predetermined patterned movement; and if the turnaround time elapses during the patterned movement, the notification controller changes at least one of a moving rate and a moving angle of the hand of the patterned movement, and reduces or extends a time required for at least one patterned movement so as to finish the last patterned movement at a timing when the turnaround time elapses.

17. The analog electronic timepiece according to claim 1, wherein the notification controller sets a moving rate of the hand for indicating a result based on the target data to be greater than a moving rate of the hand according to the notification movement.

18. The analog electronic timepiece according to claim 2, wherein the notification controller sets a moving rate of the hand for indicating a result based on the target data to be greater than a moving rate of the hand according to the notification movement.

19. The analog electronic timepiece according to claim 3, wherein the notification controller sets a moving rate of the hand for indicating a result based on the target data to be greater than a moving rate of the hand according to the notification movement.

20. A method for controlling movement of a hand of an analog electronic timepiece including a radiowave receiver that receives radiowaves from positioning satellites, acquires preassigned target data from the received radiowaves and outputs the acquired target data, and a hand that is provided to be rotatable, the method comprising:

calculating a turnaround time from input of a reception command for the radiowaves to the radiowave receiver to output of the acquired target data; and instructing the hand to carry out a predetermined notification movement during reception of the radiowaves and finish the notification movement at a timing when the turnaround time elapses.

* * * * *